US006845516B1

(12) United States Patent
Letson et al.

(10) Patent No.: US 6,845,516 B1
(45) Date of Patent: Jan. 25, 2005

(54) WACKER CHAPS

(75) Inventors: Cheryl Ann Letson, Baltic, CT (US); William K Letson, Baltic, CT (US)

(73) Assignee: William K. Letson, Canterbury, CT (US)

( * ) Notice: Subject to any disclaimer, the term of this patent is extended or adjusted under 35 U.S.C. 154(b) by 0 days.

(21) Appl. No.: 09/577,751

(22) Filed: Dec. 8, 2000

(51) Int. Cl.[7] ..... A41D 13/00
(52) U.S. Cl. ..... 2/51
(58) Field of Search ..... 2/51, 23, 242, 2/79, 46, 69, 227, 82

(56) References Cited

U.S. PATENT DOCUMENTS 712,908 A * 11/1902 Clark ..... 2/51
717,854 A * 1/1903 Holston ..... 2/51
889,470 A * 6/1908 Lyons ..... 2/51
1,153,909 A * 9/1915 Hanes ..... 2/51
1,411,562 A * 4/1922 Christian ..... 2/51
1,451,095 A * 4/1923 Greene ..... 2/51
1,478,349 A * 12/1923 Oberndorfer ..... 2/51
2,129,486 A * 9/1938 Berman ..... 2/51
2,315,972 A * 4/1943 Lindfelt ..... 2/51
2,717,387 A * 9/1955 McMahan ..... 2/22
4,266,299 A * 5/1981 Beal ..... 2/46
5,081,718 A * 1/1992 Carman et al. ..... 2/227
5,095,544 A * 3/1992 Elverskog ..... 2/22
5,361,411 A * 11/1994 Bohn et al. ..... 2/69
5,375,262 A * 12/1994 Carter ..... 2/23
5,613,250 A * 3/1997 Bell ..... 2/242
5,901,374 A * 5/1999 Foster ..... 2/82
5,970,525 A * 10/1999 Gallinot et al. ..... 2/242
6,154,884 A * 12/2000 Dehner ..... 2/69
6,317,893 B1 * 11/2001 Walton ..... 2/227
6,338,164 B1 * 1/2002 Howard ..... 2/242

* cited by examiner

*Primary Examiner*—Tejash Patel
(74) *Attorney, Agent, or Firm*—Andrews Kurth LLP

(57) ABSTRACT

A protective, front apron with adjustable straps at the neck, waist, thigh and ankle, as well as under-foot straps. The apron covers and protects the chest, legs, and feet. The fabric is commercial grade canvas or vinyl and is reversible. The apron may also be disposable. The apron may have additional features such as a pocket, tool loops, and, a pencil holder. The apron may support logos or advertising.

11 Claims, 5 Drawing Sheets

FIG. 3A.

COMPLETE PIECE LAYOUT DESCRIPTION / PLACEMENT

1 ADJUSTABLE NECK STRAP

2 ADJUSTABLE BUCKLE

3 ADJUSTALBE WAIST STRAP

4 WAIST STRAP ADJUSTMENT ( HOOK AND LOOP VELCRO )

5 SEAM WHERE TOP AND BOTTOM CONNECT

6 RIGHT ADJUSTABLE THIGH STRAP

7 RIGHT THIGH ADJUSTMENT STRAP ( HOOK AND LOOP VELCRO )

8 LEFT ADJUSTABLE THIGH STRAP

9 LEFT THIGH ADJUSTMENT STRAP ( HOOK AND LOOP VELCRO )

#10 RIGHT ADJUSTABLE ANKLE STRAP

#11 RIGHT ANKLE ADJUSTMENT STRAP ( HOOK AND LOOP VELCRO )

#12 LEFT ADJUSTABLE ANKLE STRAP

#13 LEFT ANKLE ADJUSTMENT STRAP ( HOOK AND LOOP VELCRO )

#14 RIGHT UNDER SHOE STRAP

#15 LEFT UNDER SHOE STRAP

#16 TOP PANEL

#17 RIGHT LEG PANEL

#18 LEFT LEG PANEL

#19 BINDING

WACKER CHAPS

BACKGROUND OF THE INVENTION

Various types of chaps and garments are known in the marketplace, but not one is a complete, one piece clothing apparatus that covers and protects the chest, legs, and feet.

The primary object of this invention is to protect your clothes and shoes from the messy, moist, grass clippings that are associated with weed wacking and or trimming. An extra advantage to this invention is many people like to weed wack or trim in their shorts. WACKER CHAPS will prevent injury to the legs from debris thrown from the high power of the weed wacker or trimmer. WACKER CHAPS can be worn to protect you in any messy circumstance, whether it be painting, driveway sealing, pet grooming, or washing your cars.

SUMMARY OF THE INVENTION

The present invention is a protective, front apron with adjustable straps at the neck, waist, thigh and ankle, as well as under-foot or under-shoe straps. The apron covers and protects the chest, legs, and feet. The fabric is commercial-grade canvas or vinyl and is reversible. The apron may also be disposable. The apron may have additional features such as a pocket, tool loops, and a pencil holder, etc. The apron may support logos or advertising. A currently preferred embodiment is an apron made of hunter green commercial-grade vinyl with a logo in the center of the bib. The apron can be made in different widths and heights to accommodate differing physical sizes. The apron can also be made in a generic one-size-fits-all size with highly adjustable straps.

BRIEF DESCRIPTION OF THE DRAWINGS

FIG. 3A Complete piece layout description/placement.

DETAILED DESCRIPTION

WACKER CHAPS is a garment made from durable, easy to clean, canvas/vinyl. They are hunter green in color, and have a golden yellow weed trademark located in the middle of the bib. They are reversible, and have adjustable straps at the neck, waist, thigh, and ankle. WACKER CHAPS can be made in several sizes.

The fabric is commercial grade canvas/vinyl, hunter green in color. It is reversible, and easy to clean. WACKER CHAPS can be made in selected materials.

Soon we will manufacture WACKER CHAPS in different colors and designs. There are many features that may be added to WACKER CHAPS such as a pocket, tool loops, and pencil holder. We see different logos, sports, animals, music artists, cartoon characters, and food and beverage brands printed on the bibs of future WACKER CHAPS.

There will also be a disposable line, to keep in your car for that messy tire change, or paint job.

Figure 1:
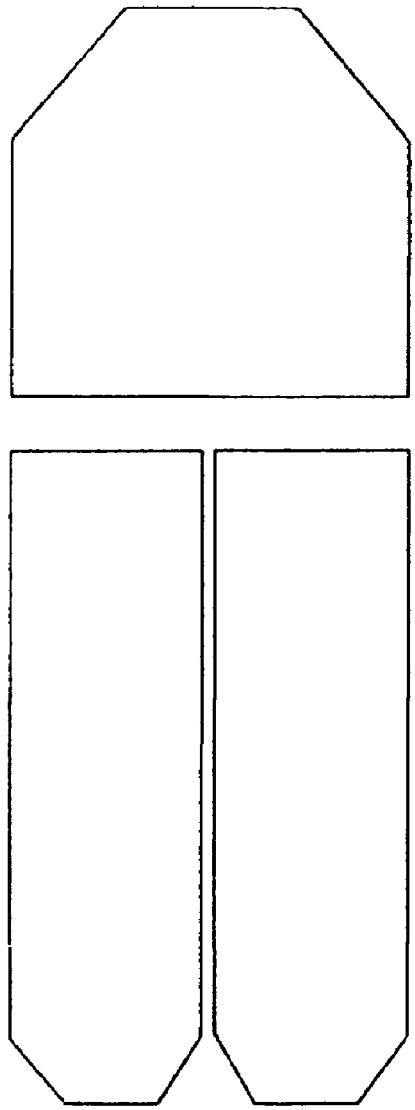
FIG. 1. Is a perspective view of the pattern layout.

The present invention is an apron with a chest portion, two leg portions, and two feet portions. The chest portion and the leg and feet panels may be sewn together. As can be seen in FIG. 1, the leg and feet portions are one piece, while the chest portion is a separate piece.

Figure 2:
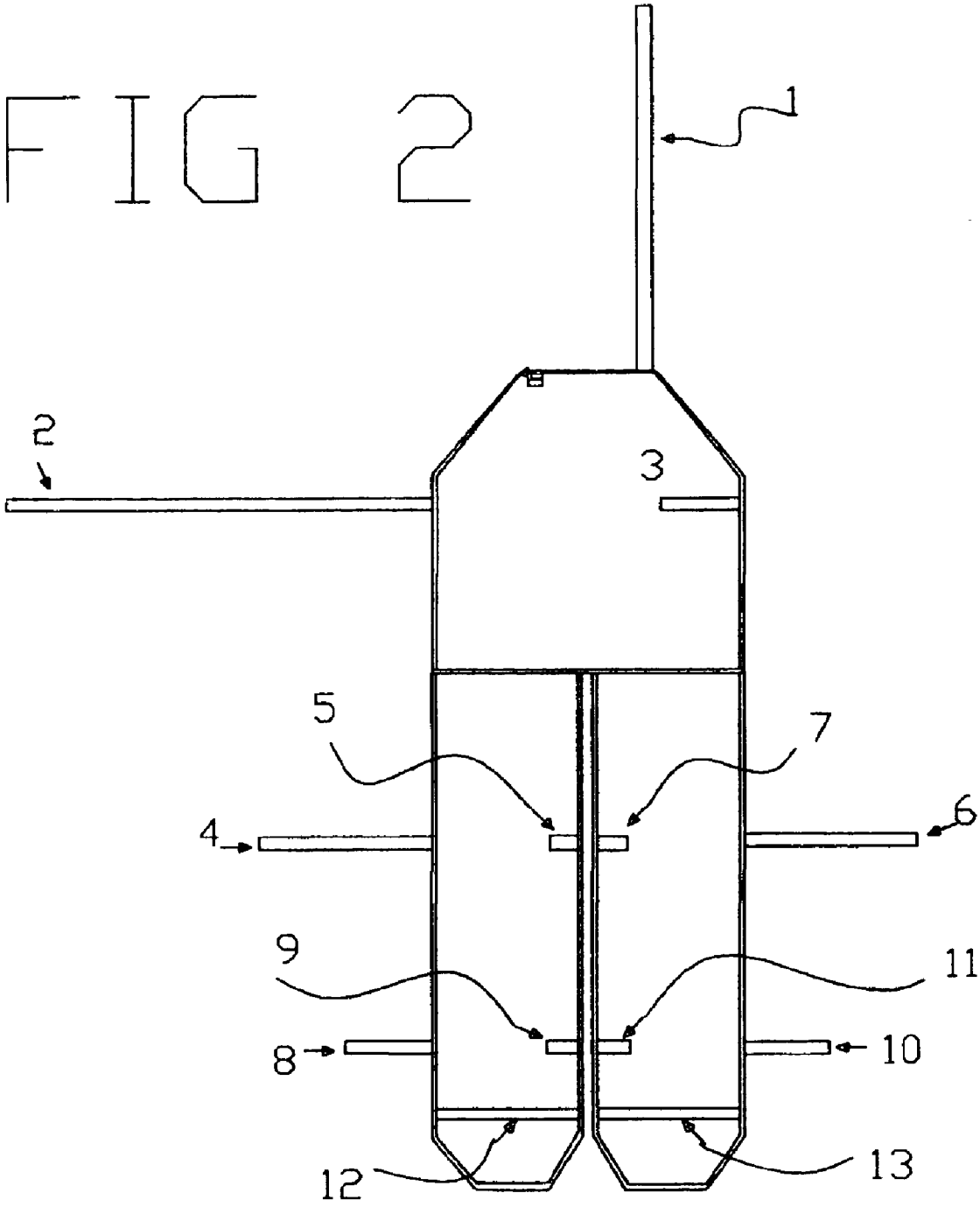
FIG. 2. Is a layout of the adjustable straps.

As can be seen in FIG. 2, the leg and feet portions are attached to the chest portion. Shown in FIG. 2 are the various straps of the present invention. These straps are an adjustable neck strap 1, an adjustable waist strap 2, a right adjustable thigh strap 4, a right thigh adjustment strap 5, a left adjustable thigh strap 6, a left thigh adjustment strap 7, an adjustable right ankle strap 8, a right ankle adjustment strap 9, an adjustable left ankle strap 10, a left ankle adjustment strap 11, a right under shoe strap 12, and a left under shoe strap 13.

Figure 3:
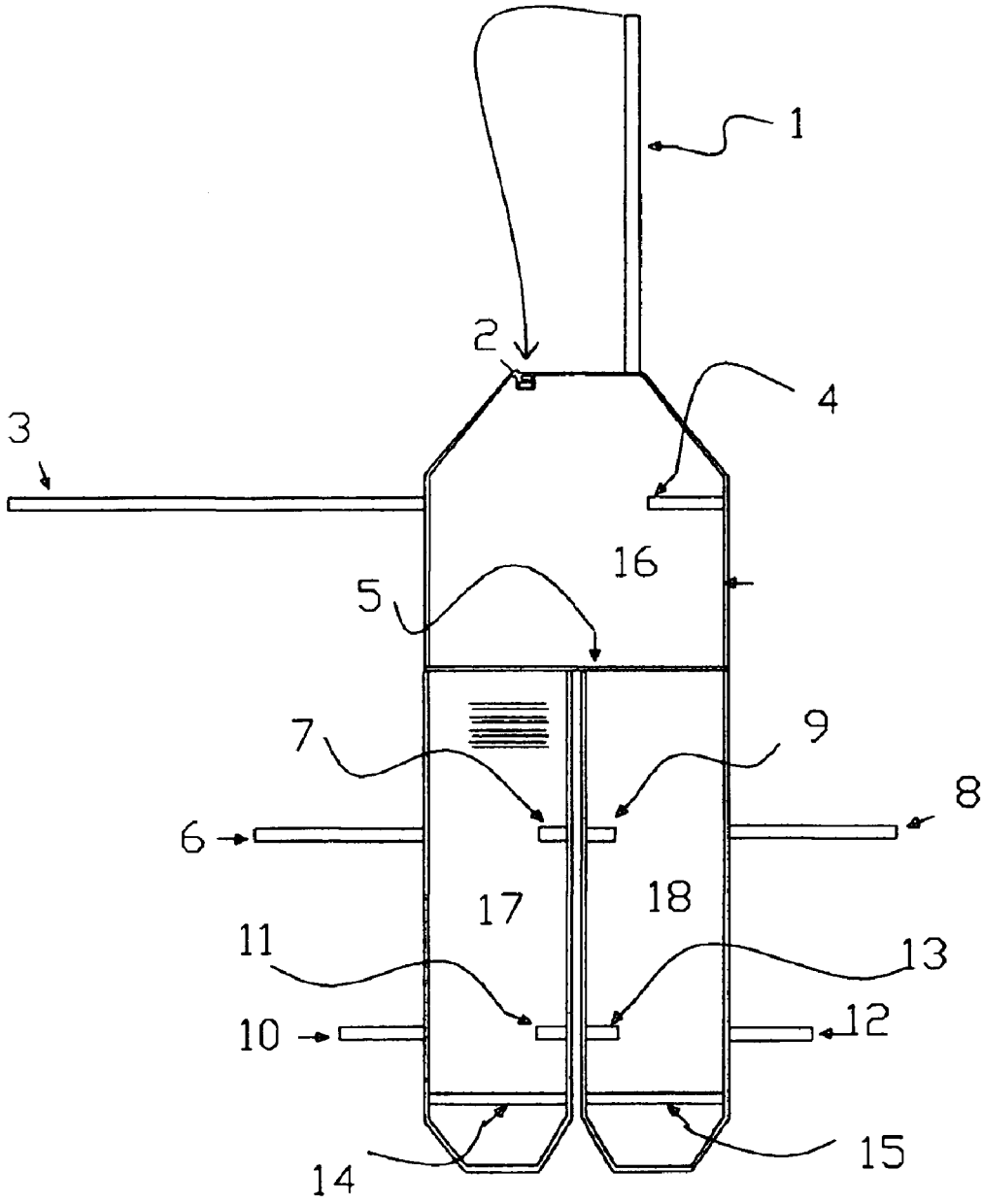
FIG. 3. Is a complete piece layout.
Figure 4:
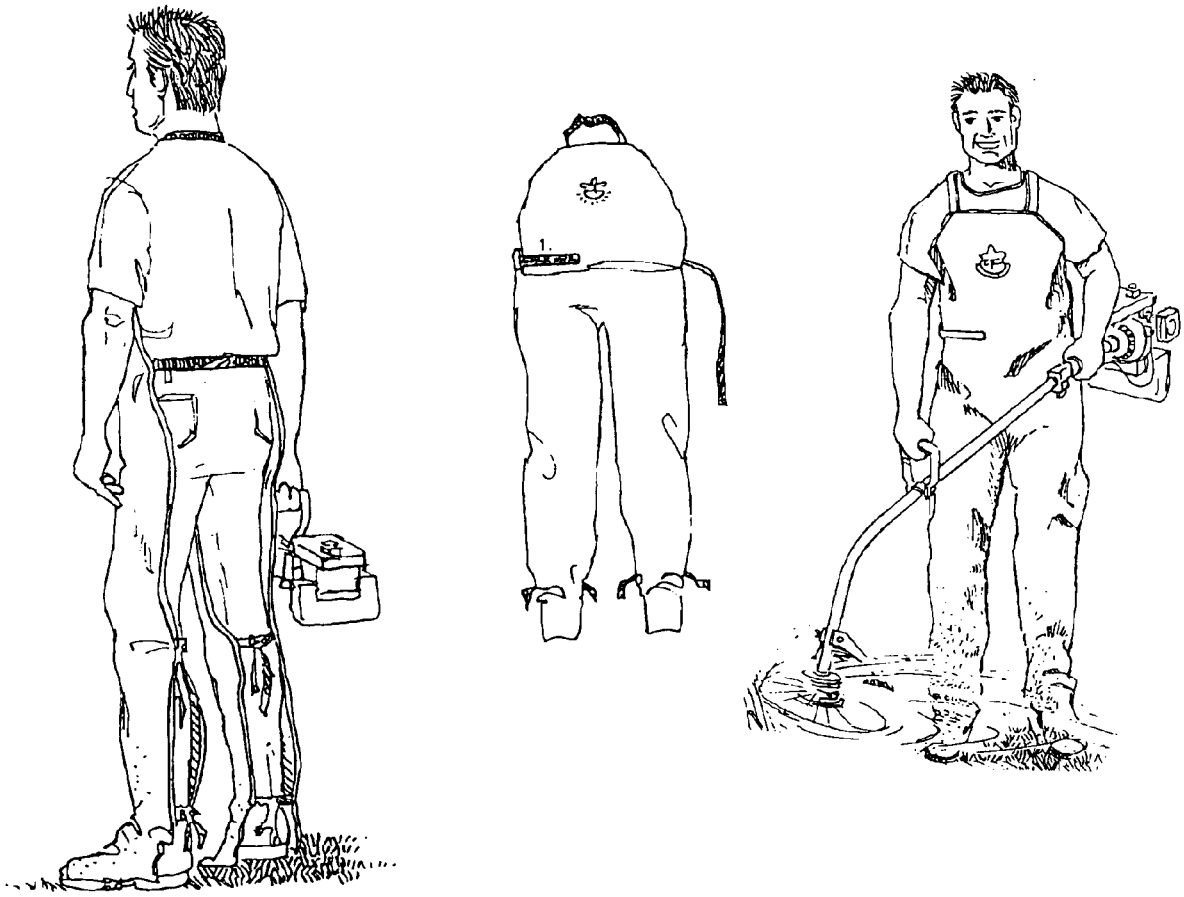
FIG. 4. Is a three dimensional rendering of the product.

Also shown in FIG. 3 are the various straps and panels of the present invention. The straps are an adjustable neck strap 1 which attaches to an adjustable buckle 2, an adjustable waist strap 3, a right adjustable thigh strap 6, a right thigh adjustment strap 7, a left adjustable thigh strap 8, a left thigh adjustment strap 9, an adjustable right ankle strap 10, a right ankle adjustment strap 11, an adjustable left ankle strap 12, a left ankle adjustment strap 13, a right under shoe strap 14, and a left under shoe strap 15. Also shown in FIG. 3 is the seam 5 between the top panel 16 of the apron and the two leg panels, the right leg panel 17 and the left leg panel 18.

What is claimed is:

1. An apron for protecting the chest, legs, and feet, said apron comprising:

a bib;

leg panels connected to the bib;

foot covers connected to the leg panels; and adjustable straps connected to the bib and leg panels, wherein the adjustable straps attach to form a neck strap, waist strap, thigh straps, and ankle straps.

2. The apron of claim 1, wherein the adjustable straps attach with buckles.

3. The apron of claim 1, wherein the adjustable straps attach by tying.

4. The apron of claim 1, further comprising:

straps connected to the feet panels.

5. The apron of claim 1, wherein the apron is made of vinyl.

6. The apron of claim 1, wherein the apron is made of canvas.

7. The apron of claim 1, wherein the apron is disposable.

8. The apron of claim 1, further comprising:

a pocket attached to the bib.

9. The apron of claim 1, further comprising:

a tool loop attached to the bib.

10. The apron of claim 1, further comprising:

a pencil holder attached to the bib.

11. The apron of claim 1, wherein the apron has a design on the bib.

* * * * *